US005158445A

United States Patent [19]

Khinkis

[11] Patent Number: 5,158,445

[45] Date of Patent: Oct. 27, 1992

[54] ULTRA-LOW POLLUTANT EMISSION COMBUSTION METHOD AND APPARATUS

[75] Inventor: Mark J. Khinkis, Morton Grove, Ill.

[73] Assignee: Institute of Gas Technology, Chicago, Ill.

[21] Appl. No.: 682,425

[22] Filed: Apr. 8, 1991

Related U.S. Application Data

[63] Continuation-in-part of Ser. No. 354,837, May 22, 1989, Pat. No. 5,013,236.

[51] Int. Cl.[5] ..... F23C 6/04

[52] U.S. Cl. ..... 431/10; 431/353; 431/352

[58] Field of Search ..... 431/2, 9, 10, 173, 284, 431/351, 352, 353, 4; 60/722, 732, 733, 39.53, 39.55

[56] References Cited

U.S. PATENT DOCUMENTS

| | | |
|---|---|---|
| 3,368,604 | 2/1968 | Mutchler . |
| 3,567,399 | 6/1968 | Altmann et al. . |
| 3,736,747 | 6/1973 | Warren . |
| 3,890,084 | 6/1975 | Voorheis et al. . |
| 3,915,619 | 10/1975 | Quigg et al. . |
| 4,021,186 | 5/1977 | Tenner . |
| 4,112,676 | 9/1978 | DeCorso . |
| 4,204,831 | 5/1980 | Vanderveen . |
| 4,375,949 | 3/1983 | Salooja . |
| 4,382,771 | 5/1983 | Carr . |
| 4,385,490 | 5/1983 | Schirmer et al. . |
| 4,395,223 | 7/1983 | Okigami . |
| 4,405,587 | 9/1983 | McGill et al. . |
| 4,427,362 | 1/1984 | Dykema . |
| 4,598,553 | 7/1986 | Saito et al. . |
| 4,651,534 | 3/1987 | Stroem . |
| 4,920,898 | 5/1990 | Solbes et al. . |
| 5,013,236 | 5/1991 | Khinkis ..... 431/10 |

FOREIGN PATENT DOCUMENTS

| | | |
|---|---|---|
| 0128792 | 12/1984 | European Pat. Off. . |
| 0281144 | 9/1988 | European Pat. Off. . |
| 036038 | 4/1978 | Japan . |
| 0105328 | 8/1979 | Japan . |
| 091108 | 7/1981 | Japan . |
| 2082756 | 3/1982 | United Kingdom . |

*Primary Examiner*—Carl D. Price

*Attorney, Agent, or Firm*—Speckman & Pauley

[57] ABSTRACT

A method and apparatus for ultra-low pollutant emission combustion of fossil fuel is disclosed in which a first portion of fuel to be combusted is introduced into a primary combustion chamber together with primary combustion air, producing either a reducing or oxidizing combustion zone and a portion of water having a heat capacity equivalent to the heat capacity of a portion of primary combustion air. The first portion of fuel is combusted in the primary combustion chamber and the combustion products derived therefrom pass through an orifice into a secondary combustion chamber. Also introduced into the secondary combustion chamber is a second portion of fuel and secondary combustion air in an amount sufficient to complete combustion of the total amount of fuel in the apparatus. In addition, water is introduced into the secondary combustion chamber in an amount having a heat capacity equivalent to an amount of secondary combustion air. The products of combustion from the secondary combustion chamber are passed through an orifice into a dilution chamber into which dilution air is introduced, producing ultra-low pollutant emissions vitiated air. The vitiated air is subsequently discharged from the dilution chamber.

46 Claims, 2 Drawing Sheets

ULTRA-LOW POLLUTANT EMISSION COMBUSTION METHOD AND APPARATUS

CROSS REFERENCE TO RELATED APPLICATION

This application is a continuation-in-part of copending U.S. patent application Ser. No. 07/354,837 filed May 22, 1989, now U.S. Pat. No. 5,013,236.

BACKGROUND OF THE INVENTION

1. Field of the Invention

This invention relates to an apparatus and method for ultra-low pollutant emission combustion of fossil fuel using a primary combustion chamber with a relatively small amount of fuel, primary combustion air, and water and a secondary combustion chamber with a relatively large amount of fuel, secondary combustion air, and water, both combustion chambers having cyclonic flow. The secondary combustion chamber is larger than the primary combustion chamber in a specified relation. A dilution chamber may be used. Combustion under these conditions results in ultralow nitrogen oxides ($NO_x$), carbon monoxide (CO) and total hydrocarbons (THC) emissions.

2. Description of the Prior Art

Existing multi-stage combustors use nozzles to mix fuel and air within a combustion chamber and other existing designs use partially premixed fuel and air prior to introducing such fuel/air mixture into a combustion chamber. Other existing combustor designs which use fully premixed fuel and air prior to introducing the fuel/air mixture into a combustion chamber use a one-stage combustion process which does not provide high flame stability at very high excess air.

U.S. Pat. No. 4,112,676 teaches a combustor wherein a small portion of fuel is injected into the upstream end to form a fuel-rich air mixture for diffusion burning. A fuel-lean/air mixture is introduced through a plurality of axially spaced inlets of the burner to result in a series of low temperature premixed flames which provide reduced, thermally formed nitrogen oxide compounds. The '676 patent does not teach cyclonic flow through the combustion chambers.

U.S. Pat. No. 4,598,553 teaches a two-stage gas turbine combustor wherein fuel/air mixture is injected into the upstream combustion chamber from a first-stage swirl burner. The main downstream burner has a plurality of air inlets formed by a plurality of vanes which are disposed in an annular passage to swirl the air. When the flow rate of the supplied fuel is large, the fuel from the air inlets moves from an inner-peripheral surface toward the outerperipheral surface of the second burner for better mixing.

U.S. Pat. No. 4,382,771 teaches a gas and steam generator having a plurality of progressively larger combustion chambers in communication through restrictive orifices. Fuel and air ar introduced at the upstream end of two of three chambers and water is introduced downstream to produce saturated or superheated steam in combination with the products of combustion. The ratio of water to fuel is relatively high.

U.S. Pat. No. 4,385,490 teaches a staged combustor having a first combustion chamber and an adjacent and downstream larger diameter and volume second combustion chamber. All fuel is injected into the upstream end of the first combustion chamber. Air may be supplied tangentially to both combustion chambers reducing nitrogen oxide and carbon monoxide emissions.

U.S. Pat. No. 4,427,362 teaches a combustion method for reducing emissions of nitrogen oxides wherein all fuel is introduced into the first combustion zone with combustion occurring with combustion air in an amount of about 45 percent to 75 percent of the total stoichiometric amount of oxygen required for complete combustion of the fuel. Remaining fuel and combustion products are maintained at a temperature of at least 1800° K. for a time sufficient to reduce the nitrogen oxides content of the mixture to a desired level following which air is added to one or more additional combustion zones for completion of combustion at a temperature of about 1600° K. to 2000° K.

U.S. Pat. No. 3,368,604 teaches a combustion device having two combustion chambers connected by a restriction orifice. All fuel is injected into the first combustion chamber and combustion air is introduced into both combustion chambers.

U.S. Pat. No. 4,651,534 teaches a gas turbine combustor having two stage combustion with all fuel injected at its upstream end. The second stage combustion zone has a larger cross section area than the first. 18 percent of the inlet air is introduced into each of the first and second combustion sections to mix with the fuel; 12 percent and 8 percent of the inlet air is introduced into the first combustion section and second combustion sections, respectively, to generate a swirling cooling flow; and the final 44 percent of the inlet air is introduced into the exhaust section to cool exhaust gases.

U.S. Pat. No. 3,915,619 teaches a gas turbine combustor wherein separate streams of air are supplied to primary and secondary combustion zones for removing heat from the primary combustion zone and reintroducing the heat into the combustor at a region spaced downstream from both combustion zones. All of the fuel is introduced at the upstream end of the first combustion zone and into a swirling stream of air so as to effect controlled mixing of the fuel and air.

U.S. Pat. No. 4,021,186 teaches a two stage combustor wherein primary combustion occurs at substoichiometric conditions in a primary combustion chamber. Air is injected at the outlet of the primary combustion chamber in such a manner that the air completely mixes with the flue gases leaving the primary combustion chamber thereby causing secondary combustion to occur within the furnace fire box or, alternatively, within the secondary combustion chamber.

U.S. Pat. No. 3,736,747 teaches a combustor having one combustion chamber with three separate combustion zones within a housing. All fuel is introduced into the upstream end of the first combustion zone and combusted in a fuel-rich flame. The flame is regeneratively cooled by air which swirls to contain and cool the flame.

U.S. Pat. No. 4,375,949 teaches a method of at least partially burning fuel introduced at an upstream end of the first stage of a two stage combustor. Fuel is partially burned in the first stage under conditions which reduce smoke and/or carbon and the partially combusted fuel is then brought into contact with a substantially nonvolatile catalyst which is active for reducing the amount of nitrogen oxides in the partially combusted fuel.

U.S. Pat. No. 4,405,587 teaches a process for reducing the concentration of nitrogen oxides in a waste stream by burning with a stoichiometric deficiency of oxygen at a temperature between about 2000° F. and about 3000° F. to provide reducing conditions followed by oxidizing the combustibles present in the combustion effluent.

SUMMARY OF THE INVENTION

It is an object of this invention to provide an apparatus and method for combustion of fossil fuel which produces ultra-low pollutant emissions of nitrogen oxides ($NO_x$), carbon monoxide (CO), and total hydrocarbons (THC). Suitable fossil fuels include natural gas, atomized oils, evaporated oils, and pulverized coals, natural gas being preferred.

It is another object of this invention to provide an apparatus and method for combustion of fossil fuel wherein a first stage of combustion burns a first fuel portion from about 1 percent to about 20 percent of the total fuel burned in the apparatus mixed with primary combustion air in an amount selected from one of a first range of about 40 percent to about 90 percent of the stoichiometric requirement for complete combustion of the first fuel portion and a second range of about 105 percent to about 130 percent of the stoichiometric requirement for complete combustion and a first portion of water in an amount having a heat capacity approximately equivalent to the heat capacity of one of an amount of air in the range of about 10 percent to about 60 percent of the stoichiometric requirement for complete combustion of the first fuel portion and an amount of air in excess of the stoichiometric requirement for complete combustion of the first fuel portion by about 20 percent to about 150 percent. The second stage of combustion burns any unburned fuel from the primary combustion chamber and an added second fuel portion of about 80 percent to about 99 percent of the total fuel burned in the apparatus mixed with secondary combustion air in an amount of about 105 percent to about 130 percent of the stoichiometric requirement for complete combustion of the second fuel in the secondary combustion chamber and a second portion of water having a heat capacity approximately equivalent to the heat capacity of an amount of air in excess of the stoichiometric requirement for complete combustion of the fuel in the secondary combustion chamber by about 20 percent to about 160 percent. The water introduced into the primary and secondary combustion chambers reduces the temperatures therein and, as a consequence, inhibits the formation of $NO_x$ emissions in the combustion products.

The apparatus for low pollutant emission combustion of fossil fuel has a first upstream end, a first downstream end and at least one first wall defining an elongated cyclonic primary combustion chamber. A second upstream end, a second downstream end and at least one second wall define an elongated cyclonic secondary combustion chamber. A dilution chamber upstream end, downstream end, and at least one dilution chamber wall define an elongated dilution chamber.

The primary combustion chamber is in communication with the secondary combustion chamber which is in communication with the dilution chamber. The dilution chamber has a discharge outlet for exhausting vitiated air, including combustion products from the secondary combustion chamber, to the outside atmosphere, a turbine, or the like.

A first fuel portion inlet nozzle is in communication with the primary combustion chamber for introducing a first fuel portion of about 1 percent to about 20 percent of the total amount of fossil fuel to be combusted in the combustor. Primary combustion air is also introduced through a first fuel portion inlet nozzle into the primary combustion chamber in an amount selected from one of a first range of about 40 percent to about 90 percent and a second range of about 105 percent to about 130 percent of the stoichiometric requirement for complete combustion of the first fuel portion. In a preferred embodiment of this invention, the primary combustion air and the first fuel portion are thoroughly mixed to form a primary fuel/air mixture which is then introduced into the primary combustion chamber through the first fuel portion inlet nozzle. In accordance with another embodiment of this invention, the first fuel portion and the primary combustion air are introduced separately through the first fuel portion inlet nozzle into the primary combustion chamber and mixed, forming a primary fuel/air mixture in the primary combustion chamber. In both embodiments, at least one first fuel portion inlet nozzle is secured to a wall of the primary combustion chamber and is in communication with the primary combustion chamber.

An igniter is mounted within the primary combustion chamber for igniting the primary fuel/air mixture within the primary combustion chamber. The primary fuel/air mixture is combusted in the primary combustion chamber at about 2000° F. to about 2700° F. thereby producing initial combustion products having ultra-low pollutant emissions.

To control the initial combustion temperature, a first portion of water having a heat capacity approximately equivalent to the heat capacity of an amount of primary combustion air approximately equivalent to one of about 10 percent to about 60 percent of the stoichiometric requirement for complete combustion of the first fuel portion and an excess of about 20 percent to about 150 percent of the stoichiometric requirement for complete combustion of the first fuel portion is introduced into the primary combustion chamber. It is apparent that the first portion of water can be introduced into the primary combustion chamber in a variety of ways, such as through a first fuel portion inlet nozzle and a first water portion inlet nozzle. In accordance with one embodiment of this invention, at least one first water portion inlet nozzle is secured to a wall of the primary combustion chamber and is in communication with the primary combustion chamber.

The initial combustion products, including unburned portions of the first fuel portion, if any, are introduced into the secondary combustion chamber. A second fuel portion, about 80 to about 99 percent of the total amount of fuel combusted in the apparatus is introduced into the secondary combustion chamber through a second fuel portion inlet nozzle. Secondary combustion air is also introduced through the second fuel portion inlet nozzle into the secondary combustion chamber in an amount of about 105 percent to about 130 percent of the stoichiometric requirement for complete combustion of the second fuel portion and any unburned portion of the first fuel portion introduced from the primary combustion chamber.

In a preferred embodiment of this invention, the secondary combustion air and the second fuel portion are thoroughly mixed to form a secondary fuel/air mixture which is then introduced into the secondary combustion chamber through the second fuel portion inlet nozzle. In accordance with another embodiment of this invention, the second fuel portion and the secondary combustion air are introduced separately through the second fuel portion inlet nozzle into the secondary combustion chamber and mixed, forming a secondary fuel/air mixture in the secondary combustion chamber. In both embodiments, the second fuel portion inlet nozzle is secured to a wall of the secondary combustion chamber and is in communication with the secondary combustion chamber. The secondary fuel/air mixture is combusted in the secondary combustion chamber at about 1700° F. to about 2600° F., producing final combustion products having ultra-low pollutant emissions.

To control the combustion temperature in the secondary combustion chamber, a second portion of water having a heat capacity approximately equivalent to the heat capacity of an amount of secondary combustion air approximately equivalent to an excess of about 20 percent to about 160 percent of the stoichiometric requirement for complete combustion of the second fuel portion is introduced into the secondary combustion chamber. It is apparent that the second portion of water can be introduced into the secondary combustion chamber in a variety of ways, such as through a second fuel portion inlet nozzle or a second water portion inlet nozzle. In accordance with one embodiment of this invention, at least one second water portion inlet nozzle is secured to a wall of the secondary combustion chamber and is in communication with the secondary combustion chamber.

Upon completion of combustion in the secondary combustion chamber, the final combustion products are introduced into the dilution chamber. Dilution air is introduced into the dilution chamber, producing ultra-low pollutant emission vitiated air at a temperature of about 100° F. to about 2500° F. The ultra-low pollutant emission vitiated air is discharged from the dilution chamber into the atmosphere, a turbine, or the like.

In a preferred embodiment of this invention, the primary combustion chamber, secondary combustion chamber and dilution chamber each have an approximately cylindrical shape and are longitudinally aligned. The downstream end of the primary combustion chamber is in communication with the upstream end of the secondary combustion chamber and the downstream end of the secondary combustion chamber is in communication with the upstream end of the dilution chamber. The downstream end of the dilution chamber is in communication with the atmosphere, a turbine or the like.

The cross-sectional area of the primary combustion chamber is about 4 percent to about 30 percent of the cross-sectional area of the secondary combustion chamber. The volume of the primary combustion chamber is about 1 percent to about 20 percent of the total combined volume of the primary and secondary combustion chambers. The volume of the dilution chamber is about 50 percent to about 250 percent of the volume of the secondary combustion chamber. In a preferred embodiment of this invention, the ratio of the length-to-diameter of each of the primary combustion, secondary combustion, and dilution chambers is about 1 to about 2.5.

At least one first fuel portion inlet nozzle and one first water portion inlet nozzle are tangentially mounted through the first wall of the primary combustion chamber near the upstream end, tangentially introducing the fuel and air and water with respect to the combustion chamber wall. At least one second fuel portion inlet nozzle and one second water portion inlet nozzle are tangentially mounted through the second wall near the upstream end of the secondary combustion chamber tangentially introducing the fuel and air and water with respect to the combustion wall. At least one dilution air inlet nozzle is tangentially mounted through the dilution chamber wall near the dilution chamber upstream end tangentially introducing air with respect to the dilution chamber wall.

In another preferred embodiment according to this invention, the downstream end of the primary combustion chamber may have a first orifice with a diameter less than that of the primary combustion chamber for exhausting initial combustion products from the primary combustion chamber into the secondary combustion chamber.

The downstream end of the secondary combustion chamber may have a second orifice with a diameter less than that of the secondary combustion chamber for exhausting complete combustion products from the secondary combustion chamber into the dilution chamber. The dilution chamber downstream end may have a dilution chamber orifice with a diameter less than that of the dilution chamber for exhausting vitiated air to either the outside atmosphere, a turbine, or the like. The orifices are preferably concentrically aligned with the chambers. In addition, the ratio of the diameter of each orifice to its respective chamber diameter should be about 0.3 to about 0.8.

In one embodiment of this invention, each of the primary combustion, secondary combustion and dilution chambers is enclosed in a cooling chamber through which a cooling fluid, preferably air, is circulated. The walls defining the primary combustion, secondary combustion and dilution chambers are constructed of ceramic materials, special metal alloys or stainless steel. In a preferred embodiment of this invention, the air, in addition to cooling the combustion chamber walls, is used to provide cooling to each orifice. The air may also be used to provide a portion of the air introduced into each of the primary combustion, secondary combustion and dilution chambers.

To enhance the cooling of the orifices, each orifice is spool-shaped, having radially extended ends. In one embodiment of this invention, a partition is positioned between and approximately parallel to the radially extended ends of each orifice such that cooling air, having a velocity of about 100 to 300 feet per second, flows along the inside surface of one radially extended end and then along the facing surface of the other radially extended end. In another embodiment of this invention, the radially extended end facing the chamber immediately downstream of the respective orifice has at least one hole through which a portion of the cooling air flows into the downstream chamber, thereby providing a portion of the total amount of air supplied to each of the secondary combustion and dilution chambers. In a preferred embodiment of this invention, the orifices are constructed of stainless steel.

In a preferred embodiment of this invention, the portion of the spool-shaped orifice between the radially extended ends has at least one hole through which a portion of the cooling air flows into the combustion products from the combustion chamber immediately upstream of the orifice as they pass through the orifice, thereby providing a portion of the total amount of air supplied to each of the secondary combustion and dilution chambers.

In one embodiment of this invention, at least one first fuel portion inlet nozzle ma be positioned in the upstream end of the primary combustion chamber, axially with respect to the first wall, to introduce fuel and air into the primary combustion chamber.

BRIEF DESCRIPTION OF THE DRAWINGS

The above mentioned and other features of this invention and the manner of obtaining them will become more apparent, and the invention itself will be best understood by reference to the following description of specific embodiments taken in conjunction with the drawings, wherein.

DESCRIPTION OF PREFERRED EMBODIMENTS

Figure 1:
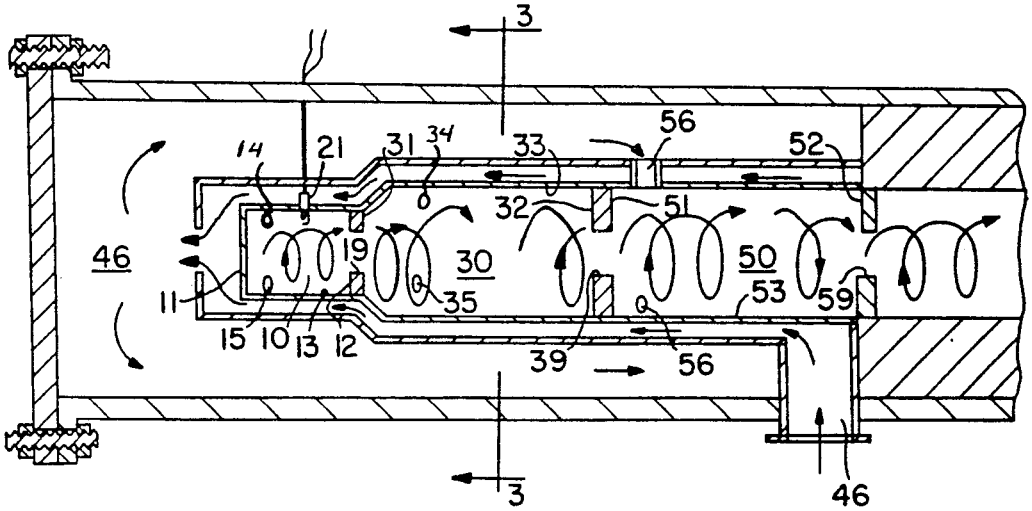
FIG. 1 shows a cross-sectional side view of one embodiment of an apparatus according to this invention for ultra-low pollutant emission combustion of fossil fuel.

FIG. 1 shows a cross-sectional side view of an apparatus for ultra-low pollutant emission combustion of fossil fuel according to one embodiment of this invention. Upstream end 11, downstream end 12 and at least one wall 13 define primary combustion chamber 10. It is apparent that primary combustion chamber 10 can have any suitable cross-sectional shape which allows cyclonic flow, preferably an approximately cylindrical shape.

The first fuel portion of about 1 to about 20 percent of the total amount of fossil fuel to be burned in the combustor is introduced into primary combustion chamber 10 through primary inlet means. Primary inlet means comprises, in accordance with one embodiment of this invention shown in FIG. 1, first fuel portion inlet nozzle 15. At least one first fuel portion inlet nozzle 15 is tangentially mounted through wall 13, preferably near the upstream end of primary combustion chamber 10 and/or axially mounted through upstream end 11. The term "tangential" refers to a nozzle being attached to the side wall of a chamber in a non-radial position such that flow through the nozzle into the chamber creates cyclonic flow about the centerline of the combustion chamber. A cylindrical shaped combustion chamber best accommodates such cyclonic flow.

Primary combustion air is also introduced through primary inlet means into primary combustion chamber 10. In the embodiment shown in FIG. 1, primary combustion air is introduced through first fuel portion inlet nozzle 15 into primary combustion chamber 10 in an amount selected from one of a first range of about 40 percent to about 90 percent and a second range of about 105 percent to about 130 percent of the stoichiometric requirement for complete combustion of the first fuel portion within primary combustion chamber 10. A first portion of water in an amount having a heat capacity approximately equivalent to one of about 10 percent to about 60 percent of the stoichiometric requirement for complete combustion of the first fuel portion and an excess of about 20 percent to about 150 percent of the stoichiometric requirement for complete combustion of the first fuel portion in primary combustion chamber 10 is introduced into primary combustion chamber 10 through primary inlet means. In the embodiment shown in FIG. 1, the first portion of water is introduced through first water portion inlet nozzle 14.

In a preferred embodiment of this invention, downstream end 12 is common with upstream end 31 of secondary combustion chamber 30. Downstream end 12 has first orifice 19 with an opening smaller than the cross section of primary combustion chamber 10 which allows initial combustion products to be exhausted from primary combustion chamber 10 into secondary combustion chamber 30. It is apparent that first orifice 19 can be positioned at any location in downstream end 12; preferably first orifice 19 is concentrically aligned in downstream end 12. It is apparent that first orifice 19 can be an orifice plate, a converging nozzle, or the like.

Igniter 21 is mounted within primary combustion chamber 10. Igniter 21 provides ignition for the first fuel portion and primary combustion air contained within primary combustion chamber 10 Igniter 21 can be a spark plug, glow plug, continuous burner, or any other suitable ignition source familiar to the art.

Upstream end 31, downstream end 32 and at least one wall 33 define secondary combustion chamber 30. Secondary combustion chamber 30 can have any cross-sectional shape which provides cyclonic flow through secondary combustion chamber 30, preferably an approximately cylindrical shape. A second fuel portion of about 80 to about 99 percent of the total fuel is introduced into secondary combustion chamber 30 through secondary inlet means. Secondary inlet means comprises, in one embodiment shown in FIG. 1, second fuel portion inlet nozzle 35. Also introduced into secondary combustion chamber 30 through first orifice 19 are combustion products, and possibly some unburned fuel, from primary combustion chamber 10. At least one second fuel portion inlet nozzle 35 is tangentially mounted through wall 33, preferably near the upstream end of secondary combustion chamber 30, to provide cyclonic flow.

Secondary combustion air is also introduced through inlet nozzle 35 into secondary combustion chamber 30 in an amount of about 105 percent to about 130 percent of the stoichiometric requirement for complete combustion of the fuel in the secondary combustion chamber. A second portion of water in an amount having a heat capacity approximately equivalent to an excess of about 20 percent to about 160 percent of the stoichiometric requirement for complete combustion of the fuel in secondary combustion chamber 30 is introduced into secondary combustion chamber 30 through secondary inlet means. In the embodiment shown in FIG. 1, the second portion of water is introduced through second water portion inlet nozzle 34. Combustion air may flow through cooling chamber 46 into first and second fuel portion inlet nozzles 15 and 35, respectively.

Downstream end 32 of secondary combustion chamber 30 is common with upstream end 51 of dilution chamber 50. Downstream end 32 has second orifice 39 with an opening smaller than the cross section of secondary combustion chamber 30 through which combustion products can be exhausted to dilution chamber 50. Second orifice 39 can be positioned at any location in downstream end 32; preferably second orifice 39 is concentrically aligned in downstream end 32. Second orifice 39 can be an orifice plate, a converging nozzle, or the like.

Upstream end 51, downstream end 52 and at least one wall 53 define dilution chamber 50 in communication with secondary combustion chamber 30. Dilution chamber 50 is also in communication with either the outside atmosphere, a turbine or other expanding device, or the like. Dilution chamber 50 can have any suitable cross-sectional shape which provides cyclonic flow through dilution chamber 50, preferably an approximately cylindrical shape. Dilution air is introduced into dilution chamber 50 through dilution air inlet means comprising dilution air inlet nozzle 56, producing vitiated air. At least one dilution air inlet nozzle 56 is tangentially mounted through wall 53, preferably near the upstream end of dilution chamber 50.

Downstream end 52 of dilution chamber 50 has dilution chamber orifice 59 with an opening smaller than the cross section of dilution chamber 50 for exhausting vitiated air to the outside atmosphere, a turbine or other expanding device, or the like. Dilution chamber orifice 59 can be positioned at any location in downstream end 52; preferably dilution chamber orifice 59 is concentrically aligned with downstream end 52. Dilution chamber orifice 59 can be an orifice plate, a converging nozzle, or the like.

In a preferred embodiment of this invention, primary combustion chamber 10, secondary combustion chamber 30 and dilution chamber 50 are longitudinally aligned. It is preferred that the cross-sectional area of primary combustion chamber 10 be about 4 percent to about 30 percent of the cross-sectional area of secondary combustion chamber 30. The volume of primary combustion chamber 10 is preferred to be about 1 percent to about 20 percent of the total combined volume of primary combustion chamber 10 and secondary combustion chamber 30. The volume of dilution chamber 50 is preferred to be about 50 percent to about 250 percent of the volume of secondary combustion chamber 30. It is preferred that the ratio of the length-to-diameter of each of the primary combustion, secondary combustion, and dilution chambers is about 1 to about 2.5. It is further preferred that the ratios of the diameter of first orifice 19 to the diameter of primary combustion chamber 10, the diameter of second orifice 39 to the diameter of secondary combustion chamber 30, and the diameter of dilution chamber orifice 59 to the diameter of dilution chamber 50 are about 0.3 to about 0.8.

In one embodiment according to this invention, first fuel portion inlet nozzle 15 is passed through upstream end 11 to provide axial introduction into primary combustion chamber 10.

In the embodiment shown in FIG. 1, primary combustion air and the first fuel portion are thoroughly mixed within first fuel portion inlet nozzle 15 to form a primary fuel/air mixture. Likewise, secondary combustion air and the second fuel portion are thoroughly mixed within second fuel portion inlet nozzle 35 to form a secondary fuel/air mixture.

Figure 2:
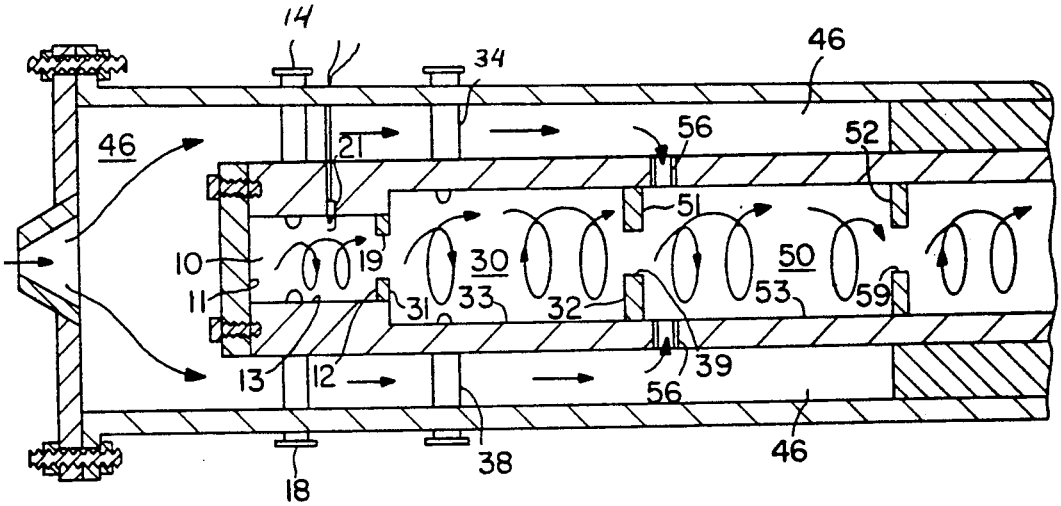
FIG. 2 shows a cross-sectional side view of another embodiment of an apparatus according to this invention for ultra-low pollutant emission combustion of fossil fuel.

FIG. 2 shows a cross-sectional side view of a combustor wherein the primary combustion air and the first fuel portion are thoroughly premixed and the secondary combustion air and the second fuel portion are thoroughly premixed prior to being introduced into primary fuel/air mixture nozzle 18 and secondary fuel/air mixture nozzle 38, respectively. At least one primary fuel/air inlet nozzle 18 is tangentially mounted through wall 33, preferably near the upstream end which provides cyclonic flow through primary combustion chamber 10. At least one secondary fuel/air inlet nozzle 38 is tangentially mounted through wall 33 preferably near the upstream end which provides cyclonic flow through secondary combustion chamber 30.

Figure 3:
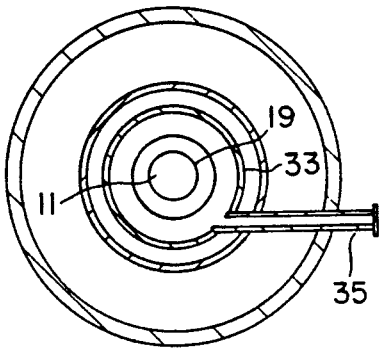
FIG. 3 shows a cross-sectional view taken along line 3—3 as shown in FIG. 1.

FIG. 3 shows a cross-sectional view along line 3—3, as shown in FIG. 1 showing second fuel portion inlet nozzle 35 in the outermost tangential location with respect to wall 33. It is apparent that the term "tangential" applies to any nozzle whose centerline does not intersect with the centerline of the chamber.

Figure 4:
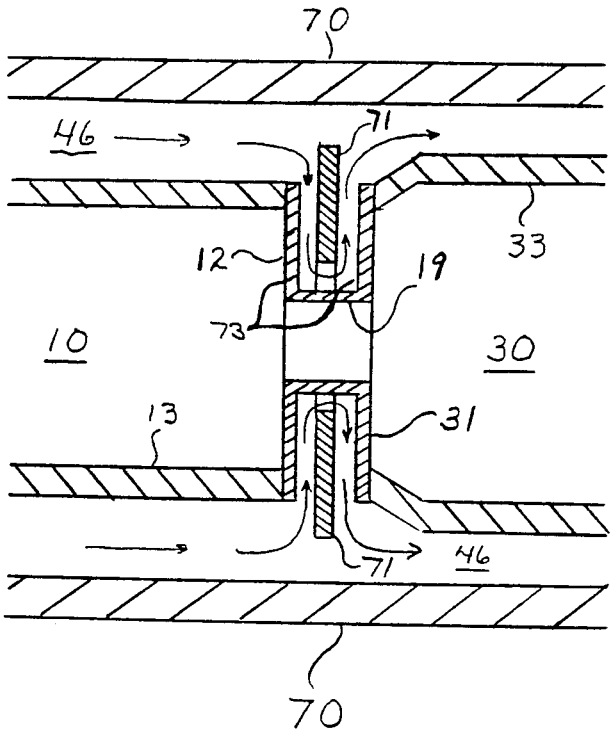
FIG. 4 shows a cross-sectional side view of an orifice in accordance with one embodiment of this invention.

FIG. 4 shows a cross-sectional side view of first orifice 19 in accordance with one embodiment of this invention. First orifice 19 is spool-shaped with radially extended ends 73. First orifice 19 has cooling means for cooling first orifice 19 comprising partition 71 positioned approximately parallel to and between the radially extended ends 73. Cooling fluid flowing through cooling chamber 46 is directed along the inner surface of one of radially extended ends 73, beneath partition 71, and then along the surface of the other of radially extended ends 73 as shown. The preferred cooling fluid is air which can also be used as primary combustion air, secondary combustion air and/or dilution air.

Figure 5:
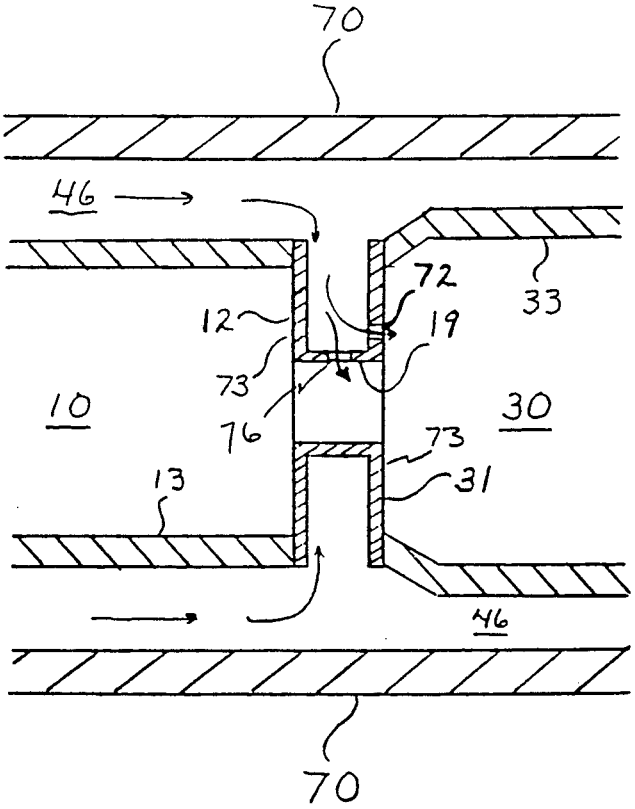
FIG. 5 shows a cross-sectional side view of an orifice in accordance with another embodiment of this invention.

FIG. 5 shows a cross-sectional side view of first orifice 19 in accordance with another embodiment of this invention. First orifice 19 has cooling means comprising at least one opening 72 positioned in radially extended end facing downstream secondary combustion chamber 30 or alternatively, at least one opening 76 positioned in the longitudinal portion of spool-shaped first orifice 19 disposed between radially extended ends 73. In accordance with this embodiment of this invention, air flowing through cooling chamber 46 is directed through opening 72 or, alternatively, opening 76 into secondary combustion chamber 30.

Cooling is provided by a high velocity jet of air with velocity of 100 to 300 feet per second and in an amount equal to about 1 percent to about 5 percent of the total amount of combustion air required to burn the fuel in the apparatus.

It is apparent that both second orifice 39 and dilution chamber orifice 19 may have embodiments like the embodiments of first orifice 19 shown in FIGS. 4 and 5. It is preferred that all orifices of this invention be constructed of stainless steel.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. An apparatus for ultra-low pollutant emission combustion of fossil fuel comprising:

a first wall defining an elongated cyclonic primary combustion chamber having a fist chamber upstream end and a first chamber downstream end, said primary combustion chamber having a cross-sectional area about 4 to about 30 percent of the cross-sectional area of an elongated cyclonic secondary combustion chamber and a volume about 1 to about 20 percent of a combined volume of said primary and secondary combustion chambers;

a second wall defining said secondary combustion chamber, said secondary combustion chamber having a second chamber upstream end and a second chamber downstream end, said primary combustion chamber in communication with said secondary combustion chamber;

a dilution chamber wall defining an elongated cyclonic dilution chamber having a dilution chamber upstream end and a dilution chamber downstream end, dilution chamber discharge means for discharging vitiated air from said dilution chamber in communication with said dilution chamber, said secondary combustion chamber in communication with said dilution chamber;

primary inlet means in communication with said primary combustion chamber for introducing a first fuel portion of about 1 percent to about 20 percent of a total amount of the fossil fuel to be burned int eh apparatus, for introducing primary combustion air into said primary combustion chamber in a primary combustion air amount of one of a first range of about 40 percent to about 90 percent and a second rang of about 105 percent to about 130 percent of the stoichiometric requirement for complete combustion of said first fuel portion and for introducing a first portion of water having a first heat capacity equivalent to a primary combustion air heat capacity of on of a primary combustion air amount abut 10 percent to about 60 percent of the stoichiometric requirement for complete combustion of said first fuel portion and an excess primary combustion air amount of about 20 percent to about 150 percent of the stoichiometric requirement for complete combustion of said first fuel portion;

said primary inlet means at least one of tangentially mounted with respect to said first wall and axially mounted in said first upstream ned;

ignition means for igniting said primary fuel/air mixture within said primary combustion chamber;

secondary inlet means in communication with said secondary combustion chamber for introducing a second fuel portion of about 80 percent to about 99 percent of said total amount of the fossil fuel and for introducing secondary combustion air into said secondary combustion chamber in a secondary combustion air amount of about 105 percent to about 130 percent of the stoichiometric requirement for compete combustion of said second fuel portion and for introducing a second portion of water having a second heat capacity equivalent to a secondary combustion air heat capacity of an excess secondary combustion air amount of about 2 percent to about 160 percent of the stoichiometric requirement for complete combustion of said second fuel portion;

said secondary inlet means tangentially mounted with respect to said second wall; and dilution air inlet means in communication with said dilution chamber for introducing dilution air into said dilution chamber.

2. An apparatus for ultra-low pollutant emission combustion of fossil fuel according to claim 1, wherein said primary combustion chamber is generally cylindrical.

3. An apparatus for ultra-low pollutant emission combustion of fossil fuel according to claim 2, wherein a ratio of the length-to-diameter of each of said primary combustion chamber, said secondary combustion chamber and said dilution chamber is about 1 to about 2.5.

4. An apparatus for ultra-low pollutant emission combustion of fossil fuel according to claim 2, wherein said primary inlet means are mounted proximate said first upstream end, and said secondary inlet means are mounted proximate said second upstream end.

5. An apparatus for ultra-low pollutant emission combustion of fossil fuel according to claim 2, wherein said secondary combustion chamber is generally cylindrical.

6. An apparatus for ultra-low pollutant emission combustion of fossil fuel according to claim 5, wherein said dilution chamber is generally cylindrical.

7. An apparatus for ultra-low pollutant emission combustion of fossil fuel according to claim 6, wherein dilution air inlet means are tangentially mounted with respect to said dilution chamber wall proximate said dilution chamber upstream end.

8. An apparatus for ultra-low pollutant emission combustion of fossil fuel according to claim 6, wherein said dilution chamber has a volume equal to about 50 to about 250 percent of the volume of said secondary combustion chamber.

9. An apparatus for ultra-low pollutant emission combustion of fossil fuel according to claim 1, wherein said primary combustion chamber, said secondary combustion chamber, and said dilution chamber are longitudinally aligned.

10. An apparatus for ultra-low pollutant emission combustion of fossil fuel according to claim 2, wherein a cooling chamber wall defines a cooling chamber surrounding at least a portion of said primary combustion chamber, said secondary combustion chamber and said dilution chamber.

11. An apparatus for ultra-low pollutant emission combustion of fossil fuel according to claim 10, wherein at least one cooling fluid inlet means for introducing a cooling fluid into said cooling chamber is disposed in said cooling chamber wall and is in communication with said cooling chamber.

12. An apparatus for ultra-low pollutant emission combustion of fossil fuel according to claim 11, wherein said cooling fluid is at least one of primary combustion air, secondary combustion air and dilution air.

13. An apparatus for ultra-low pollutant emission combustion of fossil fuel according to claim 12, wherein said first downstream end has a first orifice with a first opening cross-sectional area smaller than a first cross-sectional area of said primary combustion chamber through which initial combustion products are exhausted into said secondary combustion chamber.

14. An apparatus for ultra-low pollutant emission combustion of fossil fuel according to claim 13, wherein said first orifice is concentrically aligned with said first downstream end.

15. An apparatus for ultra-low pollutant emission combustion of fossil fuel according to claim 14, wherein said first orifice is spool-shaped, having two first radially extended ends and a first longitudinal portion extending between said first radially extended ends, one of said first radially extended ends facing said secondary combustion chamber.

16. An apparatus for ultra-low pollutant emission combustion of fossil fuel according to claim 15, wherein said first orifice has a first orifice opening in one of said first radially extended end facing said secondary combustion chamber and said first longitudinal portion through which said secondary combustion air in an amount of about 1 percent to about 5 percent of the total amount of secondary combustion air is introduced into said secondary combustion chamber.

17. An apparatus for ultra-low pollutant emission combustion of fossil fuel according to claim 15, wherein a first cooling means for cooling said first orifice is positioned between said first radially extended ends.

18. An apparatus for ultra-low pollutant emission combustion of fossil fuel according to claim 17, wherein said first cooling means further comprises a first partition positioned to direct said cooling fluid along one of said first radially extended ends and subsequently along a remaining first radially extended end.

19. An apparatus for ultra-low pollutant emission combustion of fossil fuel according to claim 12, wherein said second downstream end has a second orifice with a second opening cross-sectional area smaller than a second cross-sectional area of said secondary combustion chamber through which complete combustion products are exhausted into said dilution chamber.

20. An apparatus for ultra-low pollutant emission combustion of fossil fuel according to claim 19, wherein said second orifice is concentrically aligned with said second downstream end.

21. An apparatus for ultra-low pollutant emission combustion of fossil fuel according to claim 20, wherein said second orifice is spool-shaped, having two second radially extended ends and a second longitudinal portion extending between said second radially extended ends, one of said radially extended ends facing said dilution chamber.

22. An apparatus for ultra-low pollutant emission combustion of fossil fuel according to claim 21, wherein said second orifice has a second orifice opening in one of said second radially extended end facing said dilution chamber and said second longitudinal portion through which a first portion of said dilution air is introduced into said dilution chamber.

23. An apparatus for ultra-low pollutant emission combustion of fossil fuel according to claim 21, wherein a second cooling means for cooling said second orifice is positioned between said second radially extended ends.

24. An apparatus for ultra-low pollutant emission combustion of fossil fuel according to claim 23, wherein said second cooling means further comprises a second partition positioned to direct said cooling fluid along one of said second radially extended ends and subsequently along a remaining second radially extended end.

25. An apparatus for ultra-low pollutant emission combustion of fossil fuel according to claim 12, wherein said dilution chamber downstream end has said dilution chamber discharge means in the form of a dilution chamber orifice with a dilution opening cross-sectional area smaller than a dilution cross-sectional area of said dilution chamber.

26. An apparatus for ultra-low pollutant emission combustion of fossil fuel according to claim 25, wherein said dilution chamber orifice is concentrically aligned with said dilution chamber downstream end.

27. An apparatus for ultra-low pollutant emission combustion of fossil fuel according to claim 26, wherein said dilution chamber orifice is spool-shaped, having two dilution radially extended ends and a dilution longitudinal portion extending between said dilution radially extended ends, one of said dilution radially extended ends facing an exhaust means for exhausting combustion products.

28. An apparatus for ultra-low pollutant emission combustion of fossil fuel according to claim 27, wherein said dilution orifice has a dilution chamber orifice opening in one of said dilution radially extended end facing said exhaust means for exhausting combustion products and said dilution longitudinal portion through which a second portion of said dilution air is introduced into said exhaust means.

29. An apparatus for ultra-low pollutant emission combustion of fossil fuel according to claim 27, wherein a dilution cooling means for cooling said dilution chamber orifice is positioned between said dilution radially extended ends of said dilution chamber orifice.

30. An apparatus for ultra-low pollutant emission combustion of fossil fuel according to claim 29, wherein said dilution cooling means further comprises a dilution partition positioned to dirt a dilution cooling fluid along one of said dilution radially extended ends and subsequently along a remaining dilution radially extended end.

31. An apparatus for ultra-low pollutant emission combustion of fossil fuel according to claim 1, wherein said primary inlet means further comprises a primary water inlet means for injecting said first portion of water into said primary combustion chamber separate from said first fuel portion and said primary combustion air.

32. An apparatus for ultra-low pollutant emission combustion of fossil fuel according to claim 1, wherein said secondary inlet means further comprises a secondary water inlet means for injecting said second portion of water into said secondary combustion chamber separate from said second fuel portion and said secondary combustion air.

33. A method for ultra-low pollutant emission combustion of fossil fuel, the steps comprising:

introducing into a primary combustion chamber a first fuel portion of about 1 percent to about 20 percent of a total fuel to be combusted;

introducing primary combustion air into said primary combustion chamber in an amount of one of a first range of 40 percent to about 90 percent of a first stoichiometric requirement for complete combustion of said first fuel portion and a second range of about 105 percent to about 130 percent of said first stoichiometric requirement for complete combustion of said first fuel portion;

introducing a first portion of water into said primary combustion chamber having a first water heat capacity equivalent to a primary combustion air heat capacity of one of a primary combustion air amount of about 10 percent to about 60 percent of said first stoichiometric requirement for complete combustion of said first fuel portion and an excess primary combustion air amount of about 20 percent to about 150 percent of said first stoichiometric requirement for complete combustion of said first fuel portion;

burning said first fuel portion with said primary combustion air in said primary combustion chamber at a temperature about 2000° F. to about 2700° F. producing initial combustion products;

passing said initial combustion products into a secondary combustion chamber;

introducing into said secondary combustion chamber a second fuel portion of about 80 percent to about 99 percent of the total fuel to be combusted;

introducing secondary combustion air into said secondary combustion chamber in an amount of about 105 percent to about 130 percent of a second stoichiometric requirement for complete combustion of said second fuel portion;

introducing a second portion of water into said secondary combustion chamber having a second water heat capacity equivalent to a secondary combustion air heat capacity of an excess secondary combustion air amount of about 20 percent to about 160 percent of the stoichiometric requirement for complete combustion of said second fuel portion;

burning said second fuel portion and any remaining fuel in said initial combustion products with said secondary combustion air in said secondary combustion chamber at a temperature about 1700° F. to about 2600° F. producing final combustion products;

passing said final combustion products into a dilution chamber;

introducing dilution air into said dilution chamber producing ultra-low pollutant emission vitiated air at a temperature about 100° F. to about 2500° F.; and discharging said ultra-low pollutant emission vitiated air from said dilution chamber.

34. A method for combustion of fuel according to claim 33, wherein said first fuel portion, said primary combustion air and said first portion of water are introduced separately into said primary combustion chamber.

35. A method for combustion of fuel according to claim 33, wherein said second fuel portion, said secondary combustion air and said second portion of water are introduced separately into said secondary combustion chamber.

36. A method for combustion of fuel according to claim 33, wherein said first fuel portion and said primary combustion air are thoroughly pre-mixed forming a primary fuel/air mixture prior to introducing said primary fuel/air mixture and said first portion of water into said primary combustion chamber.

37. The method for combustion of fuel according to claim 33, wherein said second fuel portion and said secondary combustion air are thoroughly pre-mixed forming a secondary fuel/air mixture prior to introducing said secondary fuel/air mixture and said second portion of water into said secondary combustion chamber.

38. A method for combustion of fuel according to claim 33, wherein at least a portion of one of said first fuel portion, said primary combustion air and said first portion of water is introduced tangentially proximate an upstream end of said primary combustion chamber into said primary combustion chamber.

39. A method for combustion of fuel according to claim 38, wherein a remainder of at least one of said first fuel portion, said primary combustion air and said first portion of water is introduced axially into said primary combustion chamber.

40. A method for combustion of fuel according to claim 33, wherein at least a portion of one of said second fuel portion, said secondary combustion air and said second portion of water is introduced tangentially proximate an upstream end of said secondary combustion chamber into said secondary combustion chamber.

41. A method for combustion of fuel according to claim 33, wherein at least a portion of said dilution air is introduced tangentially proximate an upstream end of said dilution chamber into said dilution chamber.

42. A method for combustion of fuel according to claim 33, wherein a cooling fluid is circulated around and in contact with an outside of said primary combustion chamber, said secondary combustion chamber and said dilution chamber.

43. A method for combustion of fuel according to claim 42, wherein said initial combustion products are passed into said secondary combustion chamber through a spool-shaped first orifice having two first radially extended ends and having a fist opening cross-sectional area smaller than a first cross-sectional are of said primary combustion chamber.

44. A method for combustion of fuel according to claim 43, wherein said final combustion products are passed into said dilution chamber through a spool-shaped second orifice having two second radially extended ends and having a second opening cross-sectional area smaller and a second cross-sectional area of said secondary combustion chamber.

45. A method for combustion of fuel according to claim 44, wherein said vitiated air is passed into exhaust means for exhausting said vitiated air through a spool-shaped dilution orifice having two dilution radially extended ends and having a dilution opening cross-sectional area smaller than a dilution chamber cross-sectional area.

46. A method for combustion of fuel according to claim 45, wherein a portion of said cooling fluid is introduced into cooling means for cooling said first orifice, said second orifice and said dilution orifice.

* * * * *